US008424123B2

(12) United States Patent
Svensson

(10) Patent No.: US 8,424,123 B2
(45) Date of Patent: Apr. 23, 2013

(54) DECORATIVE DISPOSER FLANGE AND STRAINER ASSEMBLY

(75) Inventor: Ron Svensson, Smyrna, GA (US)

(73) Assignee: Opella, LLC, Riviera Beach, FL (US)

( * ) Notice: Subject to any disclaimer, the term of this patent is extended or adjusted under 35 U.S.C. 154(b) by 822 days.

(21) Appl. No.: 11/696,630

(22) Filed: Apr. 4, 2007

(65) Prior Publication Data

US 2008/0245909 A1 Oct. 9, 2008

(51) Int. Cl.
*A47K 1/14* (2006.01)

(52) U.S. Cl.
USPC ..... 4/286; 4/650; 241/46.016

(58) Field of Classification Search ..... 4/640, 650, 4/652, 286, 287, 290, 252.1, 252.6; 285/422, 285/423
See application file for complete search history.

(56) References Cited

U.S. PATENT DOCUMENTS

| | | | | | |
|---|---|---|---|---|---|
| 2,323,224 | A | * | 6/1943 | Kuhnle | 4/286 |
| 3,915,203 | A | * | 10/1975 | Solomon | 140/87 |
| 4,042,983 | A | * | 8/1977 | Carpentier | 4/291 |
| 4,150,472 | A | * | 4/1979 | Derain | 4/637 |
| 4,158,585 | A | * | 6/1979 | Wright | 4/580 |
| 4,310,933 | A | * | 1/1982 | Stratman | 4/286 |
| 4,320,540 | A | * | 3/1982 | Leavens | 4/287 |
| 5,265,281 | A | * | 11/1993 | McAlpine | 4/287 |
| 5,318,230 | A | | 6/1994 | Ferguson et al. | |
| 5,560,052 | A | | 10/1996 | Ferguson et al. | |
| 6,007,006 | A | | 12/1999 | Engel et al. | |
| 6,971,400 | B1 | | 12/2005 | Bowman et al. | |

FOREIGN PATENT DOCUMENTS

CA 2070460 2/1995

OTHER PUBLICATIONS

InSinkErator Biscuit Flange; Dec. 12, 2006; 1 page.

* cited by examiner

*Primary Examiner* — Gregory Huson
*Assistant Examiner* — Erin Deery
(74) *Attorney, Agent, or Firm* — McHale & Slavin, P.A.

(57) ABSTRACT

A sink flange for use in conjunction with a sink drain. The flange includes a flange body and a flange lip. The flange body is substantially vertical having a top end and a bottom end. The bottom end defines a flange passage therethrough. The flange lip is annular having a top side and a bottom side, which radially extends out of the top end of the flange body. The flange passage and flange lip are at least coated with a polymer.

12 Claims, 4 Drawing Sheets

DECORATIVE DISPOSER FLANGE AND STRAINER ASSEMBLY

TECHNICAL FIELD

The present invention relates generally to the field of garbage disposers and more particularly, to decorative disposer flanges and strainer assemblies.

BACKGROUND OF THE INVENTION

Garbage disposers are typical kitchen devices that are generally stored under the sink between the sink's drain and trap. The disposers shred food waste into very small pieces so that it can be passed through the plumbing without clogging. Typically, a garbage disposer is supplied with a sink flange that fits into the topside of the sink. The flange connects to the disposer below and provides a finished appearance to the sink drain. Additionally, the flange provides a reliable connection to the disposer and helps prevent water from leaking around the sink's drain.

Traditionally, residential sinks have been provided having a stainless steel finish. More recently, however, sinks have become available in a variety of colors and finishes to match the decor of a particular kitchen. Despite the fact that a greater number of sinks are colored, the typical garbage disposer is still supplied with an ordinary flange that has a stainless steel finish. Therefore, the supplied stainless steel flange does not often match the finish of the sink and can look awkward or out of place.

Recently, decorative flange masks have been introduced in an effort to achieve color continuity between the sink and the disposer flange, such as those seen in U.S. Pat. Nos. 5,318,230 and 5,560,052. However, these masks are positioned into the existing disposer flanges, often permitting liquids or food to slide between the two. Food caught between the two surfaces can cause a rotting smell to emanate from the sink and can be very difficult to remove. Additionally, food caught between the two surfaces can cause an unsanitary condition to develop. Other known decorative flanges are powder coated, which can be easily chipped or scratched by silverware or dishes. Once the powder coat is chipped, the flange cannot be repaired and must be replaced.

Thus, it can be seen that there is a need in the industry for decorative disposer flanges that are not easily chipped or scratched, while eliminating the need for decorative flange masks. It is to the provision of these needs and others that the present invention is directed.

SUMMARY OF THE INVENTION

In one aspect, the present invention provides a sink flange for use in conjunction with a sink drain. The flange includes a flange body and a flange lip. The flange body is substantially vertical having a top end and a bottom end. The bottom end defines a flange passage therethrough. The flange lip is annular having a top side and a bottom side, which radially extends out of the top end of the flange body. The flange passage and top side of the flange lip are at least coated with an impact resistant polymer. Optionally, the polymer can be colored or dyed as desired by a user. The flange body can be made from stainless steel or other durable materials. One advantage of the present invention provides for a decorative flange that is strong and durable, while allowing a user to customize the appearance of the flange to match or complement a user's sink or kitchen decor.

In another aspect, the present invention is a kit including a sink flange and a strainer assembly. The flange includes a flange body and a flange lip. The flange body is substantially vertical having a top end and a bottom end. The bottom end defines a flange passage therethrough. The flange lip is annular having a top side and a bottom side, which radially extends out of the top end of the flange body. The flange passage and top side of the flange lip are at least coated with a plastic resin. The plastic resin can be colored to match or complement a user's sink or the user's surrounding kitchen decor. The strainer assembly can have the same color as the sink flange and the exterior portion of the assembly can be coated with the plastic resin also.

In another aspect, the invention is an improvement to a flange for a sink of the type having a garbage disposer attached thereto, wherein the flange includes a flange body, flange lip, and flange passage. The improvement can include applying a thermoplastic coating to at least one surface of the flange. Optionally, the thermoplastic can be applied to the flange lip and/or the flange passage.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Typically, known garbage disposer flanges are constructed of stainless steel to impart both durability and rust-free properties to the flanges. However, stainless steel flanges often do not match the color of the sink that they are to be used in conjunction with. As colored sinks have gained in popularity in recent years, decorative disposer flanges and flange masks have been introduced so that the disposer flanges can better match the sink color or surrounding kitchen decor. Known decorative disposer flanges are presently powder coated in one or more colors of paint to achieve a decorative finish. However, this type of paint is easily chipped or scratched on impact from falling forks, knives, cups, plates, etc. Once the powder coat has been chipped or scratched it cannot easily be repaired, and more often the entire flange must be replaced. Known decorative flange masks are typically plastic covers that are inserted into the flange to mask the flange's appearance. Often a small gap exists between the masks and the flanges such that small particles of food can work their way in-between the two. The rotting food can cause foul odors and unsanitary conditions. Additionally, because there is a small gap between the flange and flange masks, water can slide in-between the two when a user is utilizing a drain stop or strainer assembly, thus making it difficult to keep water in the sink when cleaning dishes or performing other tasks requiring similar conditions.

Figure 1:
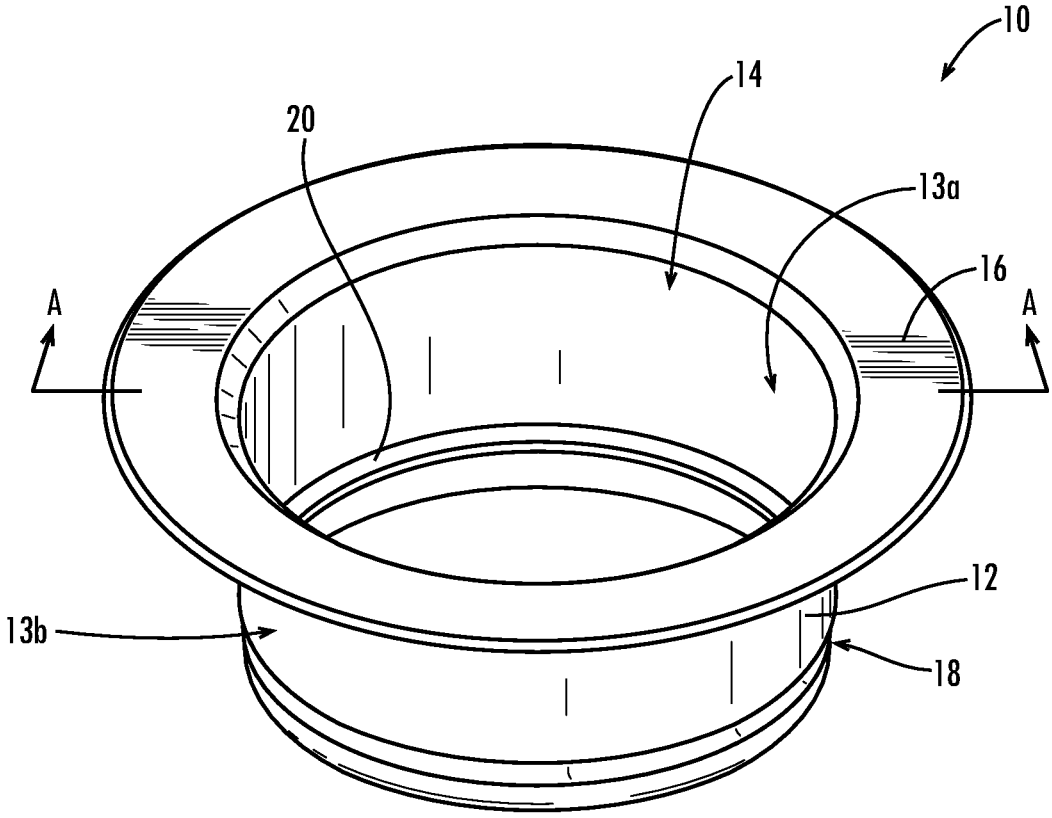
FIG. 1 is a perspective view of a decorative disposer flange according to an example embodiment of the present invention.

To combat these problems associated with known decorative disposer flanges and masks, the present invention is directed towards a decorative disposer flange that is both impact and chip resistant and prevents the problems associated with food and water sliding in-between a disposer flange and covering mask. With reference now to the drawing figures, FIGS. 1-4 depict a decorative disposer flange 10 according to example embodiments of the present invention. The flange 10, as seen in FIG. 1, generally includes a flange body 12, flange passage 14, flange lip 16, annular groove 18, and an optional drain stopper ridge 20. The flange body 12 further includes an inner surface 13*a* and outer surface 13*b*. In example embodiments, the flange 10 is substantially circular in shape, although in alternate embodiments the flange can be elliptical, rectangular, or any other shape as desired or suitable for a particular installation.

Figure 2:
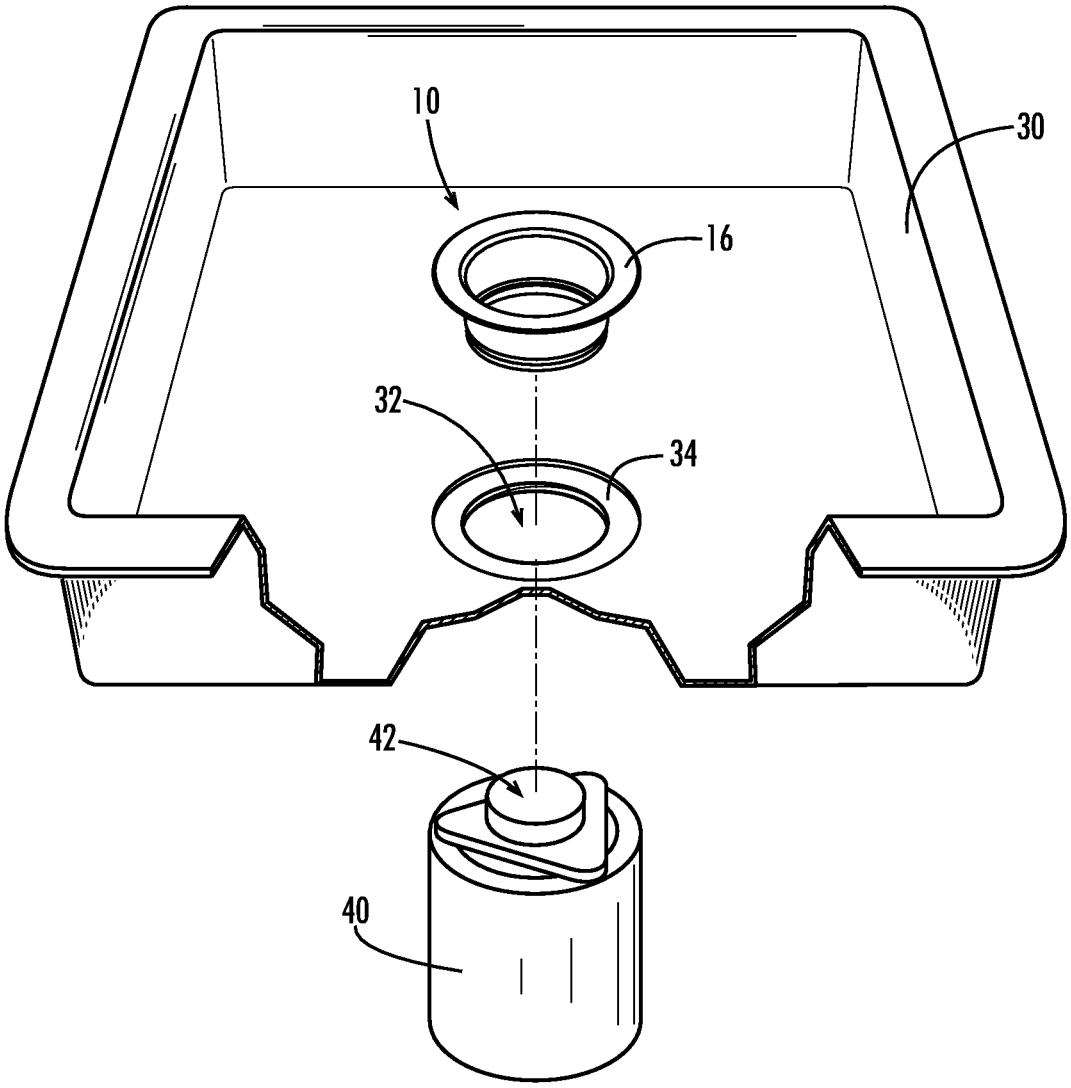
FIG. 2 is an exploded perspective view of the decorative disposer flange of FIG. 1 in combination with a sink and garbage disposer.

Typically, the flange 10 is inserted into a sink 30 through the sink's drain 32 and is preferably coupled to a garbage disposer 40 located below the sink as seen in FIG. 2. Installation procedures and methods for affixing the flange 10 to the sink 30 can vary depending on variables such as the garbage disposer model, sink design, and other conditions. In a typical commercial embodiment, however, a sealant and/or a gasket is applied to the underside of the flange lip 16 and the flange 10 is coaxially inserted into the drain 32, where the lip is mated to a corresponding recess 34 in the drain 32. The garbage disposer 40 is then typically affixed to the flange 10 by coupling a mounting apparatus 42 to the annular groove 18 of the flange.

Figure 3:
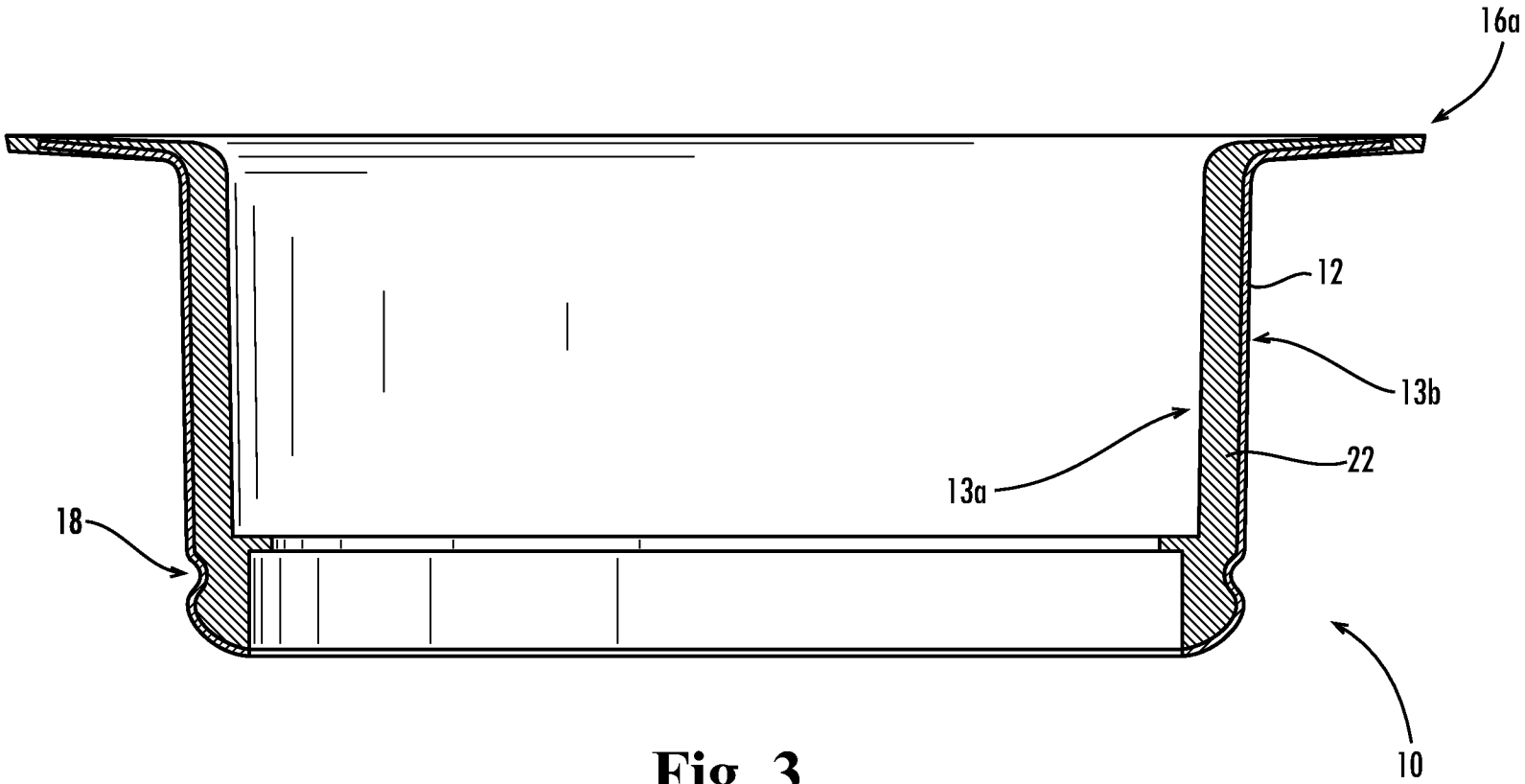
FIG. 3 is section view of the disposer flange of FIG. 1 taken along section line A-A.

In preferred example embodiments, the flange body 12 is formed from stainless steel, although in other embodiments, the flange can be formed from plastic, rubber, aluminum, or other metals. Preferably, the flange body 12 is constructed of stainless steel to impart strength, rigidity, and rust free properties to the flange. Also, preferably, the stainless steel body 12 is at least partially coated in acetal thermoplastic polymer (commercially known as CELCON® or DELRIN®) or an other impact resistant plastic 22, as seen in FIG. 3. In a typical commercial embodiment, the exterior surface 13*b* of the flange body 12 is fully coated with the plastic 22. In preferred embodiments, the body 12 is coated in CELCON® M-90 grade plastic. CELCON® plastic has been found to be highly wear and impact resistant and is also resistant to most chemicals, such that it does not degrade over time. Furthermore, such impact resistant plastics, unlike powder-coated surfaces, are generally not susceptible to being chipped or scratched by dishes, knives, forks, or other utensils. Example embodiments of the present invention, therefore, have a stainless steel body 12, for strength, longevity, and support for the garbage disposer 40, combined with a decorative, but durable, polymer finish to match or complement a user's sink or kitchen decor.

Other plastics 22 can be used in conjunction with the present invention, such as acrylics, acrylonitrile-butadiene-styrene, alkyds, cellulosics, coumarone-indene, diallyl phthalate, epoxy, fluoropolymer, melamine-formaldehyde, nitrile resins, nylon, petroleum resins, phenolic, polyamide-imide, polyarylates, polybutylene, polycarbonate, polyethylene, polyimides, polyketones, polyphenylenes, polypropylene, polystryrene, polyurethanes, polyvinyl acetate, vinyls, polyvinyl chloride, styrene acrylonitrile, styrene copolymers, sulfone polymers, thermoplastic polyester, unsaturated polyester, urea-formaldehyde, other plastic resins, etc.

The plastic coating 22 can be applied to the stainless steel body 12 by insert molding, injection molding, or other similar means of coating an object with thermoplastics. In example embodiments, as detailed in FIG. 3, the impact resistant plastic 22 is applied to the interior/visible surfaces of the flange body 13*a* including the flange passage 14, flange lip 16 and drain stopper ridge 20. Additionally, the plastic 22 can be applied to the underside of the flange lip 16, as best seen in FIG. 3, which helps prevents the plastic from peeling at the lip edge 16*a* and also helps to seal the lip against a sink when inserted therein. In a typical commercial embodiment, the exterior surfaces 13*b* of the flange body 12 do not have plastic 22 applied thereon so as to save money during the manufacturing process. However, in other example embodiments, the entire flange, including the exterior surface 13*b* can be coated in impact resistant plastic. The thickness of the applied plastic 22 can vary widely depending on the particular application. For example, the thickness of the plastic 22 can range from less than 1 mm to more than 3 mm. In preferred example embodiments, it has been found that a thickness of about 1 mm is suitable for most applications. Additionally, the plastic 22 can be colored or dyed to match or complement the color of the corresponding sink or surrounding kitchen decor. Example colors for the plastic 22 include almond, white, and biscuit, although the plastic can be any color desired by a user. Those skilled in the art will understand how to apply dye or color to the plastic resin.

Figure 4:
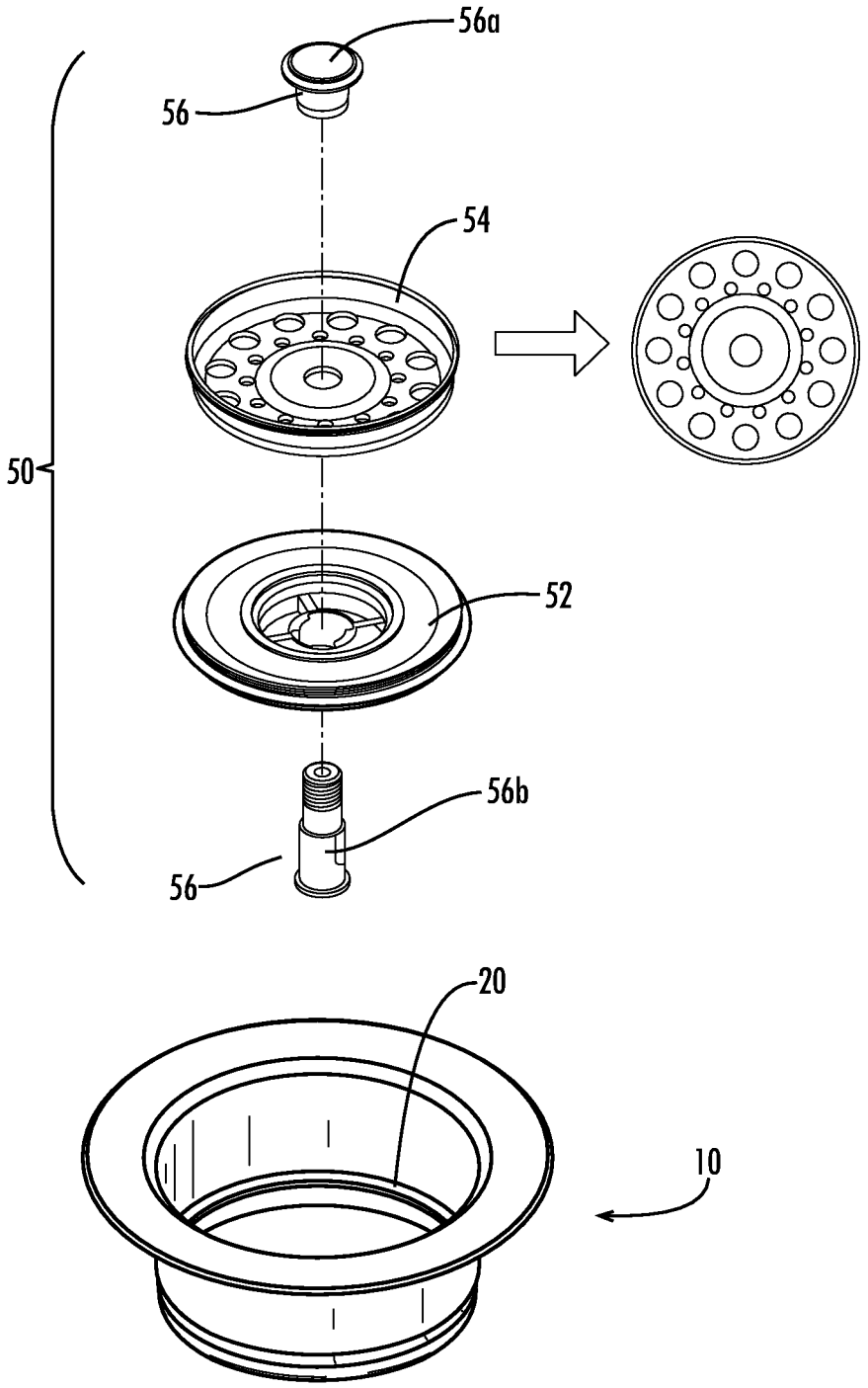
FIG. 4 is an exploded perspective view of a decorative disposer flange and strainer assembly according to another example embodiment of the present invention.

In alternative embodiments of the present invention, as seen in FIG. 4, a drain stopper ridge 20 is provided to support a corresponding strainer assembly 50. The strainer assembly 50 generally includes a drain seal 52, strainer 54, and manual sealing lock 56. The drain seal 52 and strainer 54 are generally coaxially aligned and secured together using the manual sealing lock 56. The manual sealing lock 56 can be separated into two parts: a handle 56*a* and body 56*b*. The body 56*b* can be coaxially inserted through the seal 52 and strainer 54, and the handle 56*a* can be coupled thereto. In example embodiments, the handle 56*a* is coupled to the body 56*b* via threads, although in other embodiments, glue, clips, or other means of connecting the same can be utilized. User manipulation of the sealing lock 56 can force the drain seal 52 against the flange passage 14 in a first position, whereby the seal is watertight, and away from the passage in a second position, such that the seal is liquid permeable. In the first position, the strainer assembly 50 can be used to seal the drain when the user desires to fill the sink 30 with water. In the second position, the user can drain the sink 30 of the water as desired, while preventing any knives, spoons, forks, other utensils, wedding rings, etc. from falling into the disposer.

Preferably, in example embodiments, the strainer assembly 50 of the present invention also has a decorative finish, which matches, complements, or accentuates the finish of the corresponding flange 10. The strainer assembly 50 can be formed of plastic covered stainless steel, rubber, metals, or can be comprised entirely of plastic. Impact resistant plastic, such as acetal plastic (CELCON® or DELRIN®) can be used in the construction of the strainer assembly 50 as well as the flange 10. The strainer assembly 50 can match or complement the color of the sink 30, flange 10, or surrounding kitchen decor.

In another embodiment, the present invention is a kit. The kit comprises a packaged combination of a decorative flange 10 and a strainer assembly 50, substantially as described above. A user, having a sink with a strainer assembly and flange that do not match the sink or surrounding kitchen decor, can purchase such a kit to interchange the stock or undesired strainer assembly and flange with replacements meeting the desired color choices of the user.

While the invention has been described with reference to preferred and example embodiments, it will be understood by those skilled in the art that a variety of modifications, additions and deletions are within the scope of the invention, as defined by the following claims.

What is claimed is:

1. A sink flange for use in conjunction with a sink drain comprising:

a substantially vertical cylindrical flange body having a top end and a bottom end defining a flange passage therethrough; and an annular flange lip having a top side and bottom side, said annular flange lip secured to said top end of said flange body and extending radially outwardly from said flange body;

said flange passage, said top side of said annular flange lip, and an entire surface of said bottom side of said annular flange lip are completely coated with a polymer having a color, said coating of said polymer having a thickness, said coating of said polymer on said top side of said annular flange lip and said coating on the entire surface of said bottom side of said annular flange lip extending radially outwardly from said flange passage a distance which prevents food and water from entering a passage between said annular flange lip and a sink, wherein said color of said polymer is the same color as a color of a sink into which said sink flange is to be inserted.

2. The sink flange of claim 1, wherein said flange body substantially comprises stainless steel.

3. The sink flange of claim 1, wherein said flange body comprises a material selected from plastic, rubber, and aluminum.

4. The sink flange of claim 1, wherein said polymer is thermoplastic polymer.

5. The sink flange of claim 4, wherein said polymer is acetal plastic.

6. The sink flange of claim 2, wherein said sink flange is entirely coated in polymer.

7. The sink flange of claim 1, wherein said sink flange further includes a strainer assembly, said strainer assembly being the same color as said color of said polymer on said sink flange.

8. The sink flange of claim 3, wherein said strainer assembly is formed from the same material as said sink flange.

9. The sink flange of claim 5, wherein the acetal plastic is less than about 1 millimeter thick.

10. The sink flange of claim 5, wherein the acetal plastic is between about 1 millimeter and about 3 millimeters thick.

11. The sink flange of claim 1, wherein said polymer is less than about 1 millimeter thick.

12. The sink flange of claim 1, wherein the polymer is between about 1 millimeter and about 3 millimeters thick.

* * * * *